United States Patent [19]

Chang

[11] 4,348,878

[45] Sep. 14, 1982

[54] LOCKS OF SUITCASES WITH CHANGEABLE COMBINATIONS

[76] Inventor: Orson Chang, 476-478 Fu Hsin N. Rd., Taipei, Taiwan

[21] Appl. No.: 123,709

[22] Filed: Feb. 22, 1980

[51] Int. Cl.[3] ..... E05B 37/02; E05B 65/48

[52] U.S. Cl. ..... 70/5; 70/74; 70/312

[58] Field of Search ..... 70/2, 3, 4, 5, 67, 68, 70/69, 70, 71, 72, 73, 74, 75, 76, 312, 316, 317, 318

[56] References Cited

U.S. PATENT DOCUMENTS

| | | | |
|---|---|---|---|
| 3,416,338 | 12/1968 | Gehrie | 70/312 |
| 3,952,561 | 4/1976 | Bako | 70/70 |
| 4,100,775 | 7/1978 | Bako | 70/3 |
| 4,123,923 | 11/1978 | Bako | 70/74 |

*Primary Examiner*—Robert L. Wolfe

*Attorney, Agent, or Firm*—Armstrong, Nikaido, Marmelstein & Kubovcik

[57] ABSTRACT

The present invention relates to a kind of mechanism of combination locks applied to suitcases with changeable combinations to secure high accuracy of positioning and reduce the probability of disordered combination, and is characterized by its simple structure modeled by one-piece pattern casting.

4 Claims, 10 Drawing Figures

LOCKS OF SUITCASES WITH CHANGEABLE COMBINATIONS

BACKGROUND OF THE INVENTION

Nowadays suitcases play an important role as an indispensible personal accompanying article wherever and whenever in the everyday life of many people such as those going on duty or on tour, to store all the necessities which may sometimes include highly valuable things e.g. precious jewels, sophisticated instruments, or absolutely secret decuments etc. In order to ensure the safety of the users to carry, several kinds of locking devices for suitcases have been developed, and among which, the combination lock is by far the most desirably accepted one because it is free of the trouble of carrying a key with the user. However the current suitcases combination locks are not alway satisfactory due to their liability of disordered combination and poor precision which not only incur the tendency of trouble of the locks, but also facilitate the burglars to pick them hence decrease the security and practicality of such locks.

Accordingly, it is the major object of this invention to provide an improved device of combination lock with better accuracy and less possibility miscombination and trouble.

SUMMARY

The present invention relates to combination locks, and more particularly concerns those applied to suitcases with changeable combinations characterized by the application of gate bodies as the parts of such locks which effectively remedy the flaw of the comtemporary combination locks such as inaccuracy and miscombination, and adapts best to one piece model casting to facilitate the assemblage as well as lessen the labor required in assembly line.

Numerous other features, objects and advantages of the invention will become apparent from the following specification when read in connection with the accompanying drawing in which:

DETAILED DESCRIPTION OF PREFERRED EMBODIMENTS

Figure 1:
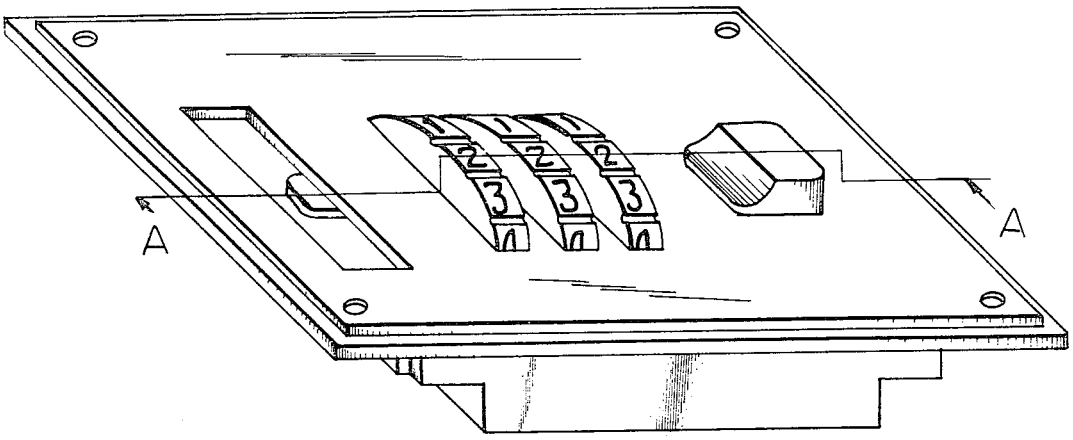
FIG. 1 is an isometric view of the configuration of this invention.
Figure 2:
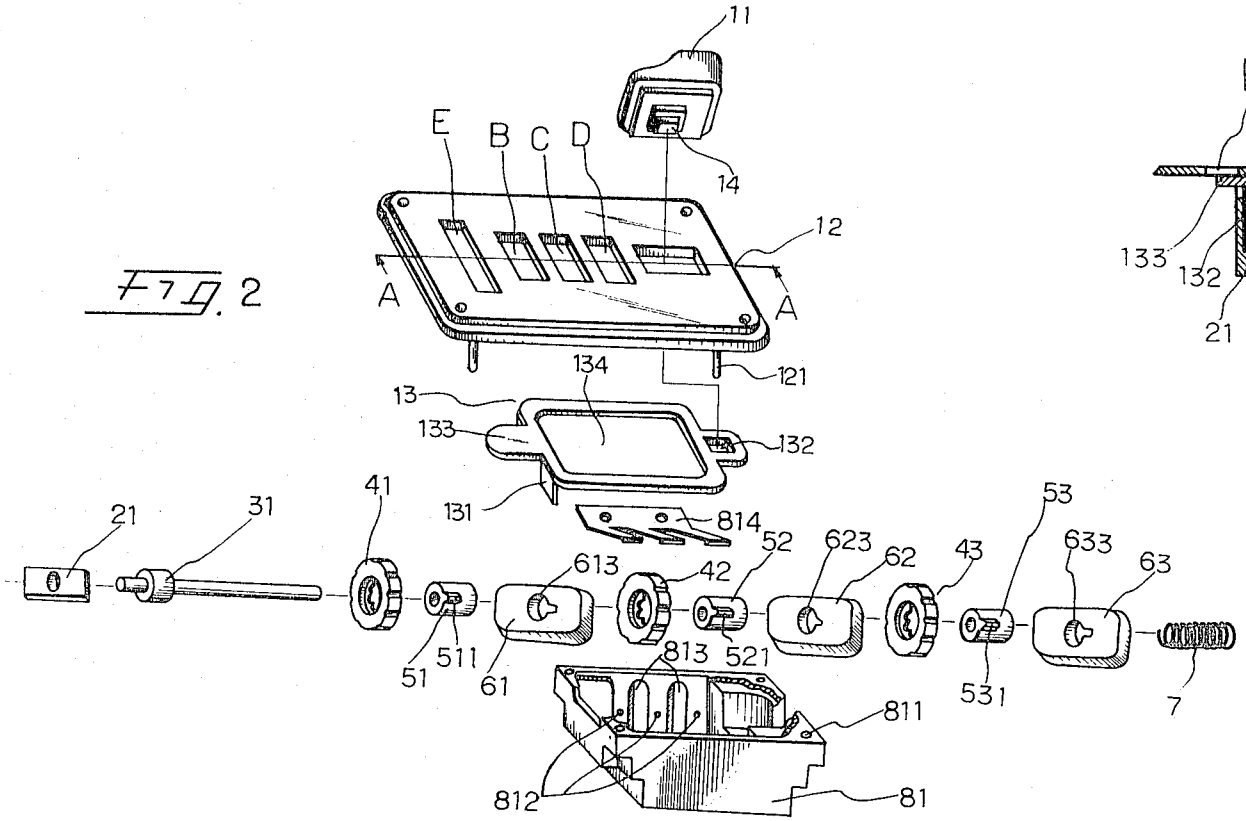
FIG. 2 is a fragmentaly view of the invention.

With reference now to the drawing and more particularly FIG. 1 thereof, there is shown a fragmentary view of the invention comprising such components as switch (11), lid (12), sliding sheet (13), stop piece (21), shaft (31), annular dials (41), (42), (43), warded bosses (51), (52), (53), gate bodies (61), (62), (63), spring (7), and case (81), in which the switch (11), lid (12), and sliding sheet (13) are jointed together by pin (14) (see FIG. 3), therefore whenever switch (11) is shifting rightward, meanwhile the sliding sheet is pulled to slide in the slot of lid (12). When assembled, all the annular dials (41), (42), (43), warded bosses (51), (52), (53), and gate bodies (61), (62), (63) are pentrated through by and mounted on shaft (31), divided into three groups and laid in place in case (81). Since the two pairs of protrusions (813) which are unseparable parts of case (81) formed by onepiece model casting bilaterally symmetrically located on both inner sides of case (81) partially partition the case into three interconnecting compartments, the annular dials, warded bosses and gate bodies can thus be divided into three sections therein (see FIG. 2 &' FIG. 3). Further, since the zenith of annular dials (41), (42), (43) after assemblage all rise above the level of lid (12), of which the width of the slots (B) (C) (D) corresponding to the very position where the annular dials are located is in accordance with the thickness of the annular dials, the positioning of the annular dials is accurately secured by the tightly clipping force exerted by the slots of the lid. Considering the positioning design of the present invention, the connection between the lid (12) and case (81) is carried out by inserting the four vertically downward legs (121) underneath the lid (12) into the four opposite holes (811) on each corner of the case, while the positioning of annular dials (41) (42) (43) and gate bodies (61) (62) (63) is accomplished by the impediment of the two pairs of protrusions (813) on both sides and the two protrudent corners on the right end of case (81), wherein the said annular dials are further tightly clamped in between by the two edges of the aforementioned slots of lid (12) to reinforce its positioning. In so doing, the present invention permits not a slightest change of the relative position of any component parts whether in dialing the annular dials or unlocking the lock, hence greatly contributes to the highly accuracy of the entire combination lock.

Having thus briefly described the basic arrangement of the present invention, its working condition is further detailed as follow. Since the zenith of annular dials are above the lid level and fixed thereon, when switch (11) shifts to the right, only the sliding sheet (12) stop piece (21), shaft (31), warded bosses (51) and spring (7) yield displacement. With regard to the force transmission, first, the switch (11) pulls the sliding sheet (13), then the latter push the stop piece (21) with its two claws (131) to pull the shaft (31) rightward, of which the thicker portion located near the frontal end simultaneously repels the adjacent warded bosses (51) (52) (53) to compress spring (7).

Figure 7:
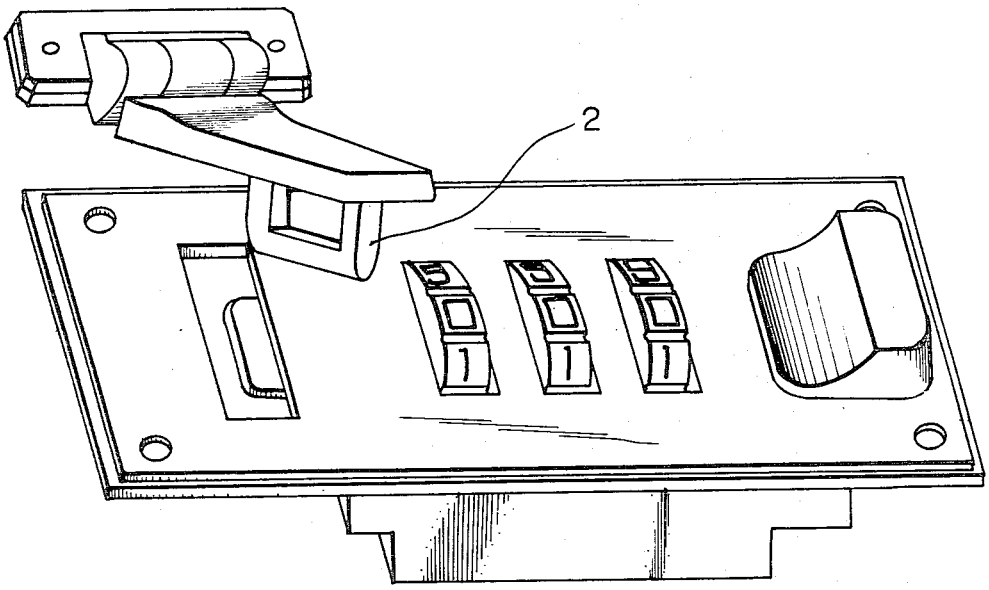
FIG. 7 is an embodiment of the present invention.
Figure 3:
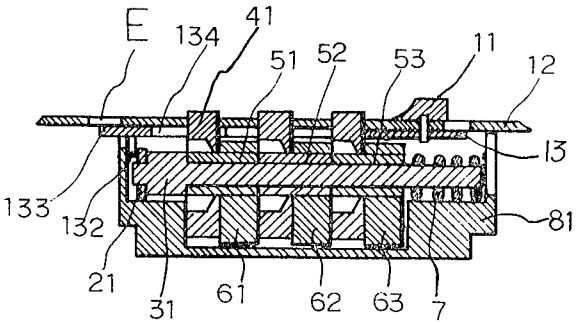
FIG. 3 is a side sectional view of the longitudinal profile along A—A.

With reference to FIG. 3, there is shown a locked condition of the invention. The reason why the suitcase can be locked lies in that when it is closed, the shackle (2) equipped on the upper part of the suitcase (see FIG. 7) is pressed down through the interspace of the lid (12) which is always installed on the lower part of the suitcase, and is then penetrated and fastened by the protrudent left end of the sliding sheet to attain the effect as a lock. Generally, if the switch undergoes no external force, the sliding sheet is removed to the locked position as illustrated in FIG. 3 by the resumptive reaction of spring (7).

Figure 4:
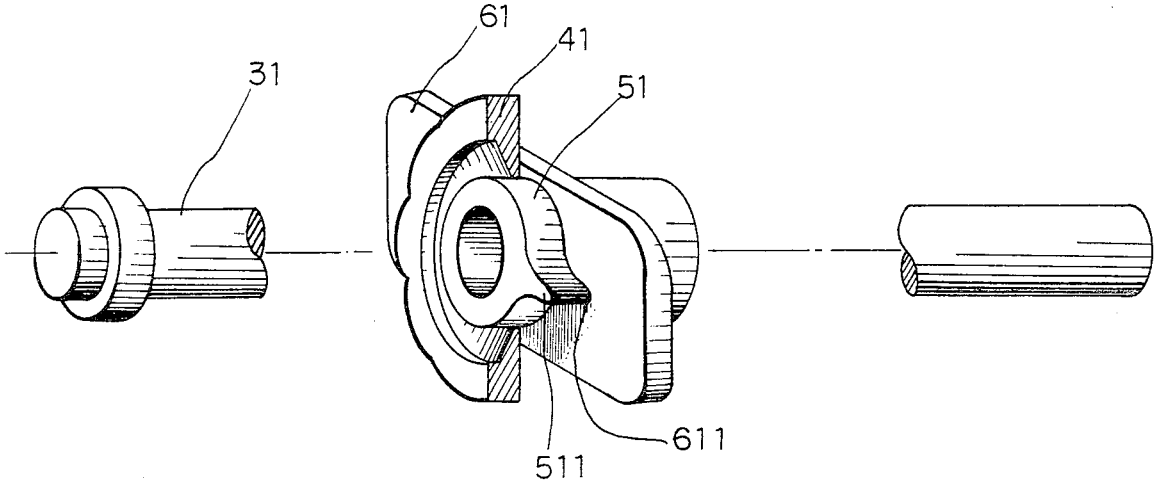
FIG. 4 is an assembled graphical representation of the shaft, annular dials, warded bosses, and gate bodies.
Figure 5:
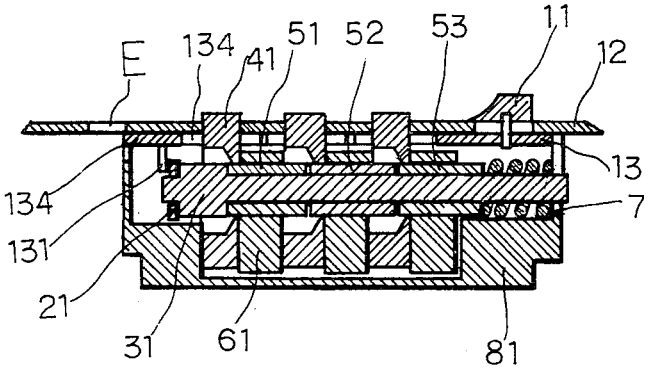
FIG. 5 is a longitudinal profile along the unlocking position A—A.

Referring to FIG. 4. When the user turns the three annular dials individually to the very code for unlocking, the annular dials (41) (42) (43) are respectively geared to their encircled warded bosses (51) (52) (53), insomuch that the unique ward (511) etc. on each warded boss may meet the notches (611) etc. on each gate. Only when the correct code is dialed can the user successfully shift the switch to change the lock into unlocked condition as shown in FIG. 5, otherwise the wards (511) (521) (531) would fail to meet the corresponding cuts on the gates bodies (61) (62) (63) coincidently, and will be stopped outside the gate thus unable to unlock the suitcase.

Figure 6:
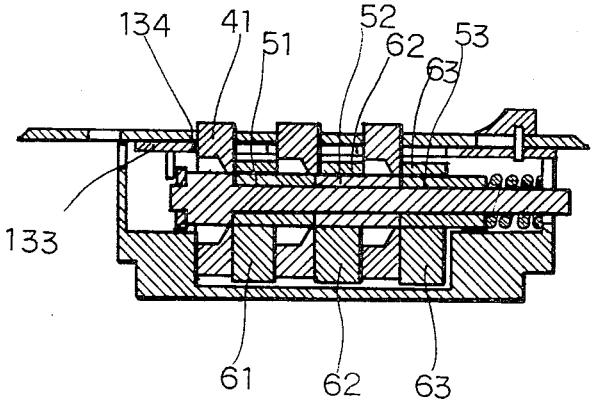
FIG. 6 is a longitudinal profile along the changeable combination position A—A.

Please refer to FIG. 6, when the combination is to be changed, first, dial the annular dials to the position of the number of the desired new code, next, shift the switch to the right limit so that the warded bosses (51) (52) (53) are all free from the constraint of the annular dials (41) (42) (43) (see FIG. 6), hitherto the user can turn the annular dials arbitrarily. When the switch is released so that the warded rings are geared by the dials again, the new number appears is the very preferred new unlocking code.

An accessory device, namely consulting apertures, can be so set (see FIG. 2) by drilling three apertures to communicate with the gate holes (613) (614) (615) of the gates bodies (61) (62) (63), and boring another three in the end of each warded bosses (51) (52) (53) opposite to the gear tooth, that the user can probe the correct code by inserting a piece of piano wire into the case and turning the annular dial. Through the aid of the piano wire, he can feel whether it meets the hole on the warded boss thereby discover the correct code. However such device helps the user having opened the suitcase to change the code yet fails to remember the combination exclusively, and offers no aid for others.

Another attachment, a spring leaf (814) is further provided on the bottom inside case (81) to hamper the further counter rotation of annular ring after having counter rotated to a certain position, thus not only protects the lock from the errors rendered by overdialing beyond the limit, but also allows the zero adjustment when unused, through the aid of the tick sounded by it to correct the combination.

To avoid the invention being misunderstood or confused with a U.S. Pat. No. 3,416,338, it is preferable to compare and discuss both in terms of their "object" "content" and "effect" in the following paragraphs. In view of their "object" both of them provide changeable combination locks for suitcase. Since the so-called "combination locks" must indispensibly comprise numbered dials through a certain way dialing of which the suitcases are unlocked, and to attain a "changeable combination", such component parts annular dials and other corresponding ones responsible for unlocking such as the warded boss must be separated, and then engaged into the annular dial. Again, each warded boss and annular dial must be penetrated through by a common shaft. Further, since both the invention and the said US patent (hereinafter called the prior case) are applied to suitcases, they will have the tendency to have similar extent of model in size and configuration. These are simplest basic principle and there is no reason for such idea to be monopolized by the prior case exclusively.

Figure 8:
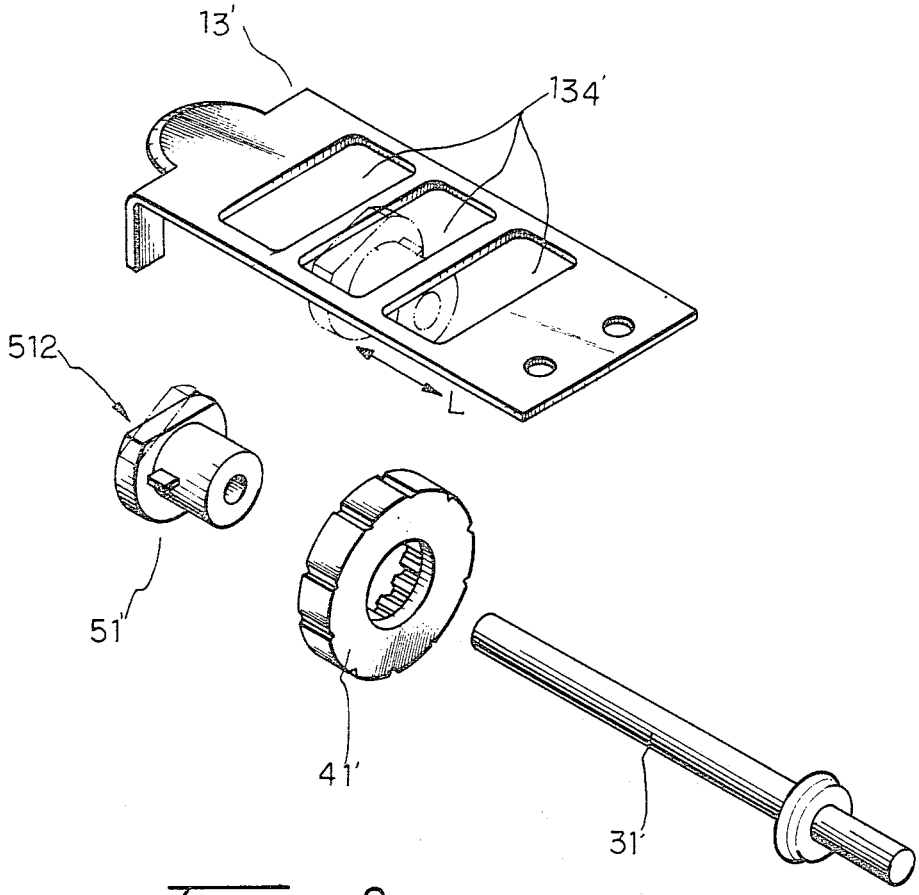
FIG. 8 PRIOR ART
FIG. 8 is a fragmentary view of the component parts of a U.S. Pat. No. 3,416,338 corresponding to the annular dials, warded bosses, gate bodies etc. of the present invention.
Figure 9:
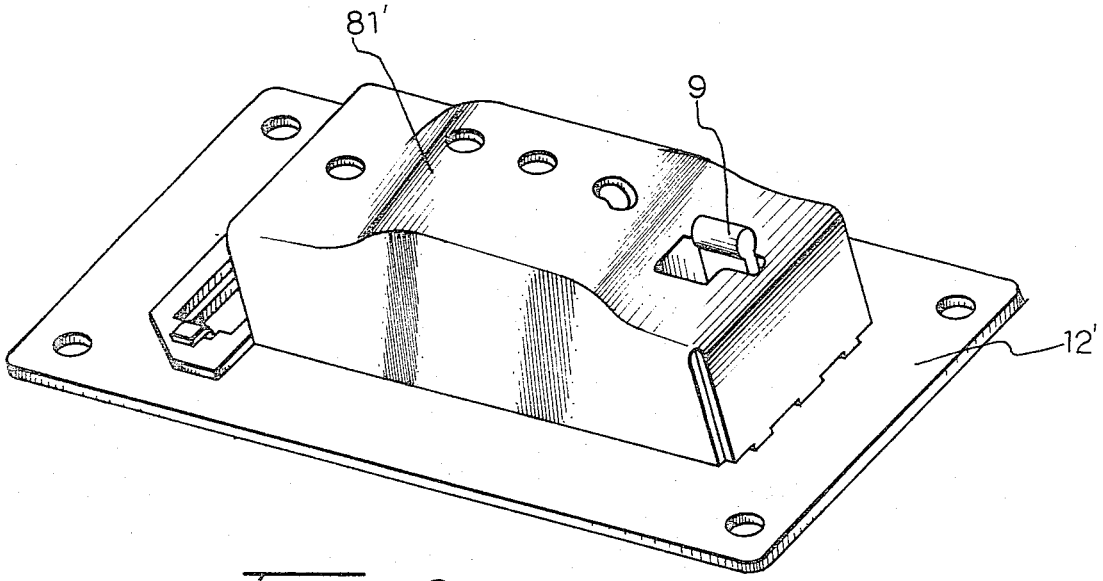
FIG. 9 PRIOR ART
FIG. 9 is the configuration of the aforesaid American patent as in FIG. 8.

With regard to the "content", the critical parts of this invention consists in the mechanism comprising annular dials (41), warded bosses (41) and gate bodies (61) to control the locking or unlocking function. Only when the ward (511) of warded boss (51) coincidently meets the corresponding notch (611) of gate body (61) can the switch (11) be shifted to pull sliding sheet (13) to push warded boss (51) through claws (131), stop piece (21), shaft (31) to bring the lock into unlocking condition, otherwise it will remain locked. Again, the combination change of this invention is merely controlled by switch (11) without an accessory combination changing rod. While the prior case, as illustrated in FIG. 8, comprises annular dial (41'), waned boss (51') instead, in which the flange on the left end of waned boss is waned to yield a straight waned side (512). There are three slots (134') parallel to each other on horizontal plate (13') which is so arranged in place together with the three said waned bosses that when the waned side (512) is turned to face upward, the waned boss does not rise above the edge of the slot of horizontal plate (13') and permits shaft (31') to push them along axial direction to unlock the suitcase. On the other hand, while the waned side does not lie in the aforesaid position, the margin of waned boss will rise above the slot and thus its axial activity is hampered thereby and is thus stayed in locked condition. Furthermore, the combination changing mechanism is accomplished by a combination changing charging rod (9) (see FIG. 9) to control the engagement or disengagement of waned bosses and annular dials.

From the above mention, it is evident the principle part of the two cases, i.e. mechanism performing unlocking and locking functions, and combination changing system, are apparently different from each other.

Figure 10:
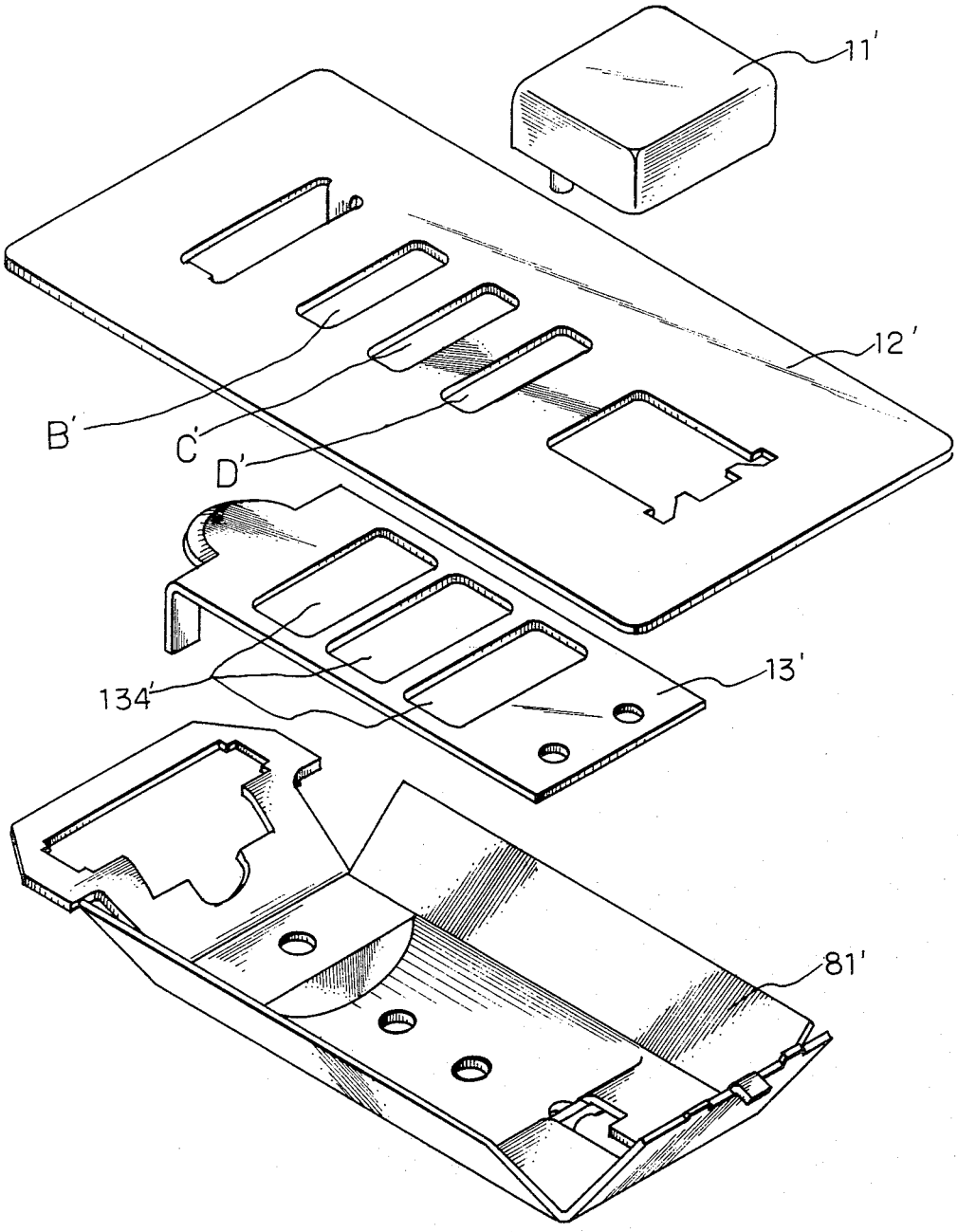
FIG. 10 PRIOR ART
FIG. 10 is a fragmentary view of the component parts of the US patent corresponding to the switch, lid, sliding sheet, and case of the present invention.

As for the difference of the "effect" between the two cases, it is more sufficient to verify the merits of the present invention in contrast with the prior case. One of the characteristic effects of the present invention lies in that the annular dials, the wards on the warded bosses and the position of notches in the gate body are all concealed inside the three gate bodies and allow nobody to detect the combination by probing with an iron piece provided it is in locked condition, hence ensure a high security of the present invention. While for the prior case, the code can be easily detected by an adroit lock picker by inserting a thin piece of plated iron from outside through the clearance of the notches (B', C', D') on the lid (12') (see FIG. 10) to touch the waned boss thereunder to feel if the flat, waned side turned upward one by one to discover the combination, hence greatly lessen its security.

Another special effect of this invention is that all the annular dials, warded bosses and gate bodies can be installed in place in case (8) together with the shaft (31) which they are penetrated by and mounted upright on, therefore it not only offers high accuracy in positioning of such component parts but also greatly facilitate the assemblage. Unlike the present invention, in the prior art the corresponding function is dependent on the height of the slotted horizontal plate (13') and the waned bosses therein, thus the accuracy is liable to be influenced by both the slight error of sizes in production and the process in assembly line, and results in its low accuracy liability of disordered combination, and the more labor require in assemblge.

A further distinguishable specialty of this invention is that the combination changing can be performed by switch (11), whereas the prior case is operated by a combination changing rod (9) located on the under side of the lock. However when practically equipped onto a suitcase, the inside lining of the latter must be inevitably bored to allow the said combination changing rod protrude thereinto. This is apparently a defect of the inside lining from the viewpoint of esthetics. Moreover, extra care must be taken in the process of boring and sewing the inside lining to make the position of the hole and the protrudent combination changing rod coincident, and increase the requisite labor and slow down the production.

Considering the comparison, the present invention and the prior case are thoroughly different whatever in the degree of security, easiness of assemblage and practicality despite their seemingly similarities.

There has been described novel apparatus and techniques for providing safe suitcase locks with changeable combinations. The present invention is thus characterized by the application of the gate bodies which ensure high accuracy of the operation of annular dials warded rings etc. and the unlocking position, and reduce the probability of disordered combination. All the parts such as the case, the lid, the annular dials, gate bodies are optimally positioned to avoid being worn away. Moreover all the parts of the invention are so designed as to adapt to one-piece pattern casting best. Besides, the optimal design of positioning can largely increase the accuracy and rate in assembly line, and facilitate the quality control.

It is evident that those skilled in the art may now make numerous uses and modifications of and departures from the specific embodiments described herein without departures from the specific inventive concepts. Consequently, the invention is to be construed as embracing each and every novel feature and novel combination of features present in or possessed by the apparatus and techniques herein disclosed and limited solely by the spirit and scope of the appended claims.

What is claimed are:

1. A combination lock having changeable combinations applicable to a suitcase comprising:

a case having an open top, a hollow interior, a plurality of paired protrusions bilaterally symmetrically located on both inside side walls of said interior partially partitioning said case into a plurality of interconnecting compartments, and a pair of end recesses at opposite ends of said interior;

a lid fitted to completely cover said open top having a plurality of slots therein;

a shaft extending from one of said recesses to the other;

a plurality of gate bodies in said case in a series parallel to each other, each one in one of said interconnecting compartments, each gate body having a hole therethrough through which said shaft extends, each said hole having a notch therein;

a plurality of warded bosses rotatably mounted on said shaft, each having a ward in a specified position on an inner margin and adapted to interact with one of said notches;

a plurality of annular dials mounted in a series parallel on said shaft, each dial having on its inner periphery corresponding cuts engageable with said wards;

a sliding sheet slidably retained between said lid and said case having a portion adapted to engage with a shackle on the suitcase and at least one claw extending interiorly of said case;

a switch engaged with said sliding sheet to move the same;

a stop piece housed in one of said recesses and engaged with one end of said shaft, said claw engaging said stop piece; and a spring mounted on said shaft biasing said gate bodies, warded bosses and annular dials towards said stop piece, said spring being in the recess opposite the recess housing said stop piece.

2. The combination lock in accordance with claim 1 wherein the recess having said spring therein is sized such that said switch can be moved passed the position where said sliding sheet portion disengages said shackle, whereupon said claw engages said stop piece to shift said warded bosses out of engagement with said annular dials so that the combination can be changed.

3. The combination lock in accordance with claim 1 wherein all the parts are moulded by one-piece-pattern casting, and the lid is fixed on the case by inserting the four processes underneath the former into the four corresponding holes on the latter, while all the annular dials and gate bodies are clipped to fix in the case, and is characterized by that the lid is installed a few slots thereon with their width equivalent to the thickness of their corresponding annular dials which slightly rise above the level of and are tightly clipped by the edges of the slots.

4. The combination lock in accordance with claim 1, in which the spring leaf is fixed onto the bottom inside the case, and is characterized by that it can prevent the annular dials from being further counter rotated after having been counter rotated to a certain position, and meanwhile make a sound when this position is reached.

* * * * *